United States Patent [19]

Bauer

[11] 4,266,093

[45] May 5, 1981

[54] COMPATIBLE FOUR CHANNEL RADIO BROADCAST AND RECEIVING SYSTEM

[75] Inventor: Benjamin B. Bauer, Stamford, Conn.

[73] Assignee: CBS Inc., New York, N.Y.

[21] Appl. No.: 18,967

[22] Filed: Mar. 9, 1979

[51] Int. Cl.[3] ..... H04S 3/02; H04H 5/00

[52] U.S. Cl. ..... 179/1 GQ; 179/1 GH

[58] Field of Search ..... 179/1 GQ, 1 GH, 1 GD, 179/100.1 TD, 100.4 ST; 325/36

[56] References Cited

U.S. PATENT DOCUMENTS

| | | | |
|---|---|---|---|
| 3,814,858 | 6/1974 | Parker | 179/1 GH |
| 3,937,896 | 2/1976 | Bauer | 179/1 GQ |
| 4,013,841 | 3/1977 | Ohkubo et al. | 179/1 GH |
| 4,115,666 | 9/1978 | Ogura | 179/1 GQ |
| 4,152,542 | 5/1979 | Cooper | 179/1 GQ |

*Primary Examiner*—Douglas W. Olms
*Attorney, Agent, or Firm*—Spencer E. Olson

[57] ABSTRACT

A compatible four channel system primarily for use in conjunction with a radio transmission system for transmitting four individual audio signals over a medium having primary and secondary information channels and first and second auxiliary information channels, the primary and secondary channels carrying information that is consistent and compatible with existing monophonic and stereo-phonic standards. More particularly, the primary information channel carries a signal representing the sum of SQ-encoded composite signals LT and RT the secondary information channel carries a signal representing the difference between LT and RT, and the first and second auxiliary channels carry auxiliary signals T and Q, respectively, which each contain, to the extent they are present, equal reduced-amplitude proportions of the four individual audio signals in predetermined angular relationships which exhibit an equal angular relationship respecting corresponding signals in composite signals representing the sum and difference of LT and RT, respectively. The T signal is utilized in a receiver/decoder to diminish "unwanted" signals in the four individual audio signals, and the Q signal may additionally be used to effect virtual cancellation of such "unwanted" signals.

17 Claims, 11 Drawing Figures

LF
RF
45°
RB
LB
Σ
Δ
.71 LB
.71 RB
.5 LF
.5 RF
.5 LB
.5 RB
LT
RT
T
Q
1.000
0.707
0.500
0.354
−0.500
−0.354
61
62
63
64
65
66
67
68
69
71
72
73
75
76
77
78
79
80
ψ + 0
ψ − 90°

COMPATIBLE FOUR CHANNEL RADIO BROADCAST AND RECEIVING SYSTEM

BACKGROUND OF THE INVENTION

This invention relates to quadraphonic audio systems, and more particularly to systems for encoding four or more individual channels of audio information for broadcast over FM multiplex radio, and for decoding and reproducing the broadcast information either as four discrete audio output signals having the directionality of the original input signals of "semi-discretely" in the manner of matrix systems, the broadcast information being fully compatible with existing monophonic and stereophonic receivers. The subject matter of this application is related to the subject matter in commonly assigned U.S. Pat. Nos. 3,937,896 entitled "Compatible Four Channel Radio Broadcast and Receiving System" and 3,940,559 entitled "Compatible Four Channel Recording and Reproducing System".

The nature of the encoding employed in the "SQ" quadraphonic record system described in applicant's U.S. Pat. No. 3,890,466, has made it possible to broadcast quadraphonic information over FM multiplex radio in a manner which is fully compatible with monophonic and stereophonic receivers. In a broadcast mode, the two composite signals produced by and SQ encoder or transduced from an SQ record, each of which contains three of the four input signals with preselected amplitude and phase relationships, can be transmitted in the same manner as a conventional stereophonic signal pair. Upon reception, a conventional monophonic or stereophonic FM receiver gives the listener a totally satisfactory monophonic or stereophonic presentation, as the case may be. If an SQ decoder of the type described in applicant's U.S. Pat. No. 3,835,255, is used in combination with the stereophonic FM receiver, the listener can obtain four-channel reproduction of the four signals contained in the transmitted composite signals. Such a system of quadraphonic transmission is at times designated a "4-2-4" system because four signals are transmitted and received via 2-channels.

It is a primary object of the invention to provide an improved system for broadcasting and receiving four independent channels discretely or semi-discretely, in a manner that is fully compatible with existing SQ decoders, as well as with existing stereophonic and monophonic receivers.

As further background for understanding the present invention and the differences between it and the more simplified method of SQ broadcasting alluded to above, it will be useful to discuss in further detail the characteristics and limitations of simply transmitting the two composite encoded signals. Employing the SQ system, the broadcaster can use an SQ encoder, of which several types are disclosed in applicant's U.S. Pat. No. 3,890,466 for combining the four channels of a four-channel program, either live or taped, into two composite signals, and transmitting them through existing FM stereo transmitter equipment. This approach provides satisfactory results at the receiver as long as there are no soloists or important instruments placed in the center-back of the quadraphonic field. It is a characteristic of the basic SQ code that center-back signals are encoded in phase opposition and thus are not received through a monophonic receiver; however, they are reproduced normally with stereophonic FM receivers and are properly decoded when replayed through an SQ encoder.

Thus, the SQ code does not significantly handicap a record producer because he can be careful to avoid placing soloists in the "dead back" of the audience.

Unfortunately, the broadcasting program director often does not have the opportunity to carefully plan and edit the material being encoded for broadcast. He may have to transmit any four-channel program through the SQ system, for example, from an existing tape, which might contain a center-back soloist, or a live rock concert during the broadcast of which an artist might wander between the back-channel microphones. To accommodate these contingencies, the broadcast producer can use the "forward-looking" encoder illustrated in FIG. 20 of the aforementioned U.S. Pat. No. 3,890,466 which treats the center-back signal in an in-phase manner as if it were a center-front signal. Using this encoder, the sounds around the front and sides of the quadraphonic field, including left-back, left-front, center-front, right-front, and right-back channels are ideally coded, the signals between the back channels are redistributed among all the channels, and the center-back signal is moved forward to the center-front position. With this code, then, all listeners, monophonic, stereophonic and quadraphonic, hear all of the signals, but the quadraphonic listener perceives center-back signals as if they originated at center-front. In any event, it will be appreciated that the quadraphonic listener, using a matrix decoder, does not hear four discrete signals; each is "contaminated" to some degree with lower level signals from two other channels, as is inherent in "matrix" four-channel systems.

Although the above-described SQ system of broadcasting provides generally acceptable quadraphonic reproduction at the receiver, which can be further improved to approach the quality of discrete reproduction through the use of logic and control circuitry in conjunction with the matrix decoder, there is considerable current interest in providing a system for broadcasting four channels in a manner which allows fully discrete presentation at the receiver. Again, such a system should still retain full compatibility with conventional stereophonic and monophonic receivers and be capable of operation on frequency channels allocated by the Federal Communications Commission. To achieve these ends, one can first appropriately combine the four signals of the four-channel program into a two-channel mono-compatible stereophonic program for transmission over existing FM broadcast channels and also provide for transmission of two additional sets of signals which, upon reception followed by appropriate combination of received signals, will enable restoration of the original four program signals. In one proposed system of which applicant is aware, four audio signals are combined or matrixed to form a pair of signals designated (LF+LB) and (RF+LB) and the sum and difference of these signals are transmitted by an FM multiplex transmitter. The four program signals are also matrixed into two additional signals (LF+RF)−(LB+RB) and (LF+RB)−(RF+LB) which are transmitted simultaneously as modulation on additional subcarriers. Upon reception, the four sets of matrixed signals are appropriately recombined to derive the original four audio signals LF, RF, LB and RB. Such a system is generically designated as a 4-4-4 system because the four original program signals are combined and transmitted as four matrixed signals and upon reception are recombined back to the four original program signals. Also it has been proposed, as a means of saving spectrum bandwidth, that only the first three of the four matrixed signals be transmitted. This is known as a "4-3-4" or semi-discrete approach, resulting in reconstitution of program signals which are "contaminated" with signals from other channels to a lesser degree than that which occurs with a 4-2-4 system. A number of systems employing this basic scheme of signal combination, including the system described in Dorren U.S. Pat. No. 3,708,623 have been evaluated by the NQRC (National Quadraphonic Radio Committee). It is unnecessary for present purposes to discuss the merits of the above described sets of signals, except to point out that each of them statistically carries equal amounts of power with the consequence that it is necessary to transmit a relatively high total signal energy to perform the "discretizing" operation.

While the advantages to be derived from "discrete" or semi-discrete quadraphonic broadcasting are at this time inconclusive, and a variety of proposals are being considered, it would be desirable, in the event that a discrete system of quadraphonic broadcasting is adopted, that such systems be compatible with SQ decoders and decoder-equipped radio receivers currently in the hands of consumers. It is an object of the present invention to provide a four channel system of broadcasting which allows fully discrete or semi-discrete reception but which is also compatible with existing monophonic, stereophonic and SQ receiving and reproducing equipment.

Furthermore, it should be noted that with the systems described in the previous paragraph the monophonic listener hears the sum of the signals (LF+LB+RF+RB) while the stereophonic listener hears the (LB+LF) signal in the left channel and the (RF+RB) signal in the right channel; and it has been demonstrated through tests conducted by the Federal Communications Commission and reported in FCC's Project Number 2710-1 dated August, 1977 that SQ-coded signals in either the monophonic or the stereophonic mode are preferred by the listeners to the signal display as defined by the equations given immediately above. Thus, another object of this invention is to provide to the stereophonic and monophonic listeners the benefit of superior SQ sound at the same time offering an improved means of transmitting a program in either the semi-discrete or fully discrete transmission modes.

SUMMARY OF THE INVENTION

The present invention is primarily directed to a compatible four channel system for use in conjunction with a radio transmission system for transmitting four individual audio signals designated LF (Left Front), LB (Left Back), RB (Right Back) and RF (Right Front) over a medium having primary and secondary information channels and first and second subsidiary information channels, the primary and secondary channels carrying information that is consistent and compatible with existing monophonic and stereophonic standards. In accordance with the preferred embodiment of the invention, means are provided for forming a first composite signal designated LT (Left Total) which contains, to the extent they are present, LF in a dominant proportion and LB and RB in sub-dominant proportions. Means are also provided for forming a second composite signal designated RT (Right Total) which contains, to the extent they are present RF in a dominant proportion and LB and RB in sub-dominant proportions, LB and RB in the above-mentioned two signals LT and RT being phase shifted with respect to each other. Means are provided for forming a sum signal (LT+RT) and for applying it to the primary information channel, and a difference signal (LT−RT) and for applying this difference signal to the secondary information channel. Finally, means are provided for producing a T-signal and Q-signal which are transmitted on additional subcarriers. In accordance with the preferred embodiment of the invention, a receiver/decoder is provided which includes means responsive to the primary and secondary channels for processing the sum and difference signals to obtain the first and second composite signals, LT and RT, and optionally to recover signals T and Q, or only T. The signals LT and RT are decoded using an SQ decoder and the decoded signals LF′, RF′, LB′, and RB′ are optionally combined with suitably phase-shifted T and Q signals to provide potentially a more accurate impression of the original four program signals.

The original program signals can be encoded in a variety of ways to provide the signals at the receiver necessary to accomplish the "discretizing" function, several of which are described below. A feature of each of the described embodiments is that the signal energy in the auxiliary signals carrying the information necessary to accomplish the discretizing operations is significantly lower than the signal energy in the primary and secondary information channels. As a consequence, the total signal energy that must be handled by the transmitter is lower than that required for other systems that have been proposed for discrete broadcasting of four channel program information.

Some of the described embodiments comprise decoding and combining means which reduce the number of phase-shift networks required in the transmitter and the receiver, with consequent manufacturing economy.

Further features and advantages of the invention will become apparent from the following detailed description when taken in conjunction with the accompanying drawings.

DESCRIPTION OF THE PREFERRED EMBODIMENT

Figure 1:
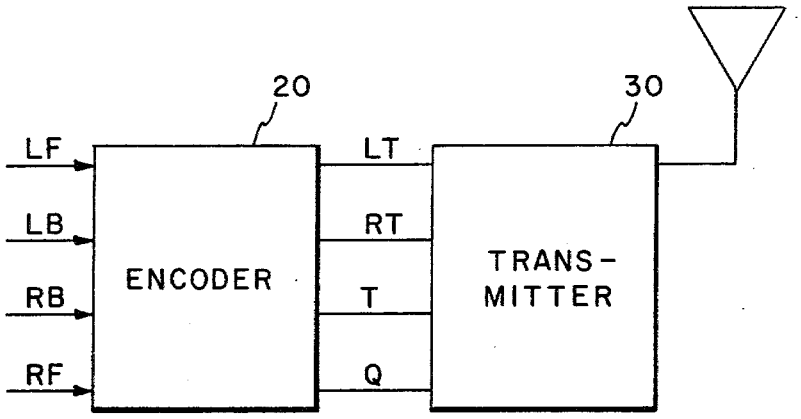
FIG. 1 is a simplified block diagram of a transmitter system embodying the present invention.

Referring to FIG. 1, there is shown a simplified block diagram of an SQ-compatible FM transmitter system that is responsive to four independent audio input signals designated LF, LB, RB, and RF. This transmitter broadcasts FM signals which are compatible with existing monophonic, stereophonic and SQ standards for consumers who have such equipment. The transmitted FM signal also includes auxiliary signals, designated T and Q, that can be processed by consumers having appropriate decoding equipment. As will become apparent, consumers having a certain type of decoding equipment will be capable of recovering the four original audio signals in fully discrete form, i.e., in the 4-4-4 mode, whereas consumers having another type of decoding equipment will be capable of obtaining four audio signals that are in "semi-discrete" form; i.e., in the 4-3-4 mode, exhibiting greater relative separation than the decoded SQ outputs without "logic" enhancement, but which are not fully discrete.

Still other types of decoding equipment, such as SQ equipment will be able to receive "4-2-4" or SQ-decoded matrixed signals only affording the type of separation which usually requires "enhancement" by use of an electronic logic. As will also become apparent, various options will be available at the transmitter regarding the number of auxiliary signals to be transmitted and the nature of these signals, depending upon the desired broadcasting objectives.

The four independent audio signals LF, LB, RB, and RF are received by an encoding block 20 which includes, inter alia, an SQ encoder for producing SQ composite signals designated LT and RT and additional encoding circuitry for generating the auxiliary signals designated T and Q. As is well-known, existing stereophonic multiplex transmitters add the total left and right audio information to produce a sum signal called a main or "primary information signal" (for a particular FM station) which occupies the portion of the frequency spectrum lying between about 50 Hz and 15 KHz. Also, a difference signal is formed by subtracting the total right audio information from the total left audio information and this difference is used to modulate a suppressed sub-carrier at 38 KHz. The result is a suppressed-carrier double side band signal called a "secondary information signal" centered at 38 KHz and occupying the frequency range from about 23 KHz to 53 KHz of the frequency spectrum. A 19 KHz pilot signal is also provided to enable detection of 38 KHz sidebands. In some cases, there is additionally broadcast a "Subsidiary Communication Authorization" ("SCA") signal at 67 KHz, although it has been suggested that this SCA signal could be eliminated for stations where four independent audio signals are to be transmitted in the 4-4-4 mode.

In the present invention the composite SQ signals LT and RT serve as Left Total and Right Total audio signals, respectively, and are encoded and then applied to the primary and secondary channels of a station in conventional fashion as primary and secondary information signals. As previously indicated, consumers having existing monophonic and stereophonic equipment or existing SQ equipment and who can receive (LT+RT) (only in the monophonic case) or who are able to obtain LT and RT separately (as in the stereophonic case) will be able to do so without loss of compatibility. Of course, consumers who also have SQ decoding equipment will be able to further process the composite signals LT and RT to obtain four decoded SQ signals as is described in detail in the above-referenced patent. The auxiliary signals T and Q can be employed in various ways to cause modulation over selected remaining portions of the frequency spectrum associated with the station being broadcast. This is illustrated with the aid of FIG. 2 which is a conceptual representation of the manner in which auxiliary signals can be used to modulate subcarriers to obtain various frequency distributions within a station allocation. The audio baseband or primary information channel carries the signal $\Sigma=(LT+RT)$, seen to occupy a frequency range from about 50 Hz to 15 KHz in the conventional manner. Also, another channel is formed by the 38 KHz subcarrier which carries the secondary information signal, i.e., the difference signal $\Delta=(LT-RT)$, seen to occupy the frequency range from 23 KHz to 53 KHz. These two channels of information, plus the pilot shown at 19 KHz, are the necessary constitutents for the transmission of conventional stereophonic signals over an FM-modulated transmitter.

Another channel, also occupying the range 23 KHz to 53 KHz, can be obtained by modulating the suppressed 38 KHz subcarrier in a quadrature relationship with respect to the previously described modulation of said subcarrier by the difference signal (LT−RT). An auxiliary signal designated T is employed for this quadrature modulation so as to yield a quadrature frequency space shown in dashed line. Also, a 76 KHz subcarrier can be modulated by another auxiliary signal designated Q. The two resulting modulation bands, shown in solid and dashed lines, can ultimately be recovered using a multiple of the transmitted 19 KHz pilot signal.

Figure 2:
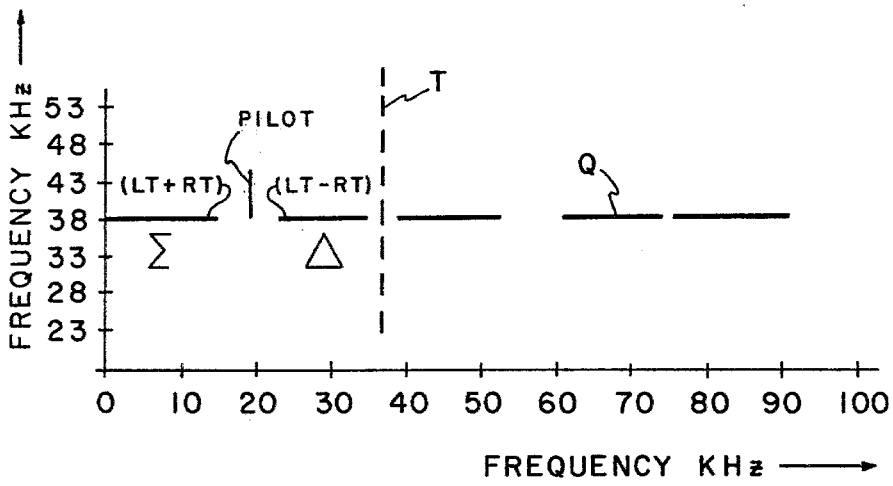
FIG. 2 is a diagram showing the frequency spectrum of a composite signal employed for the transmission of four channels of information.
Figure 3:
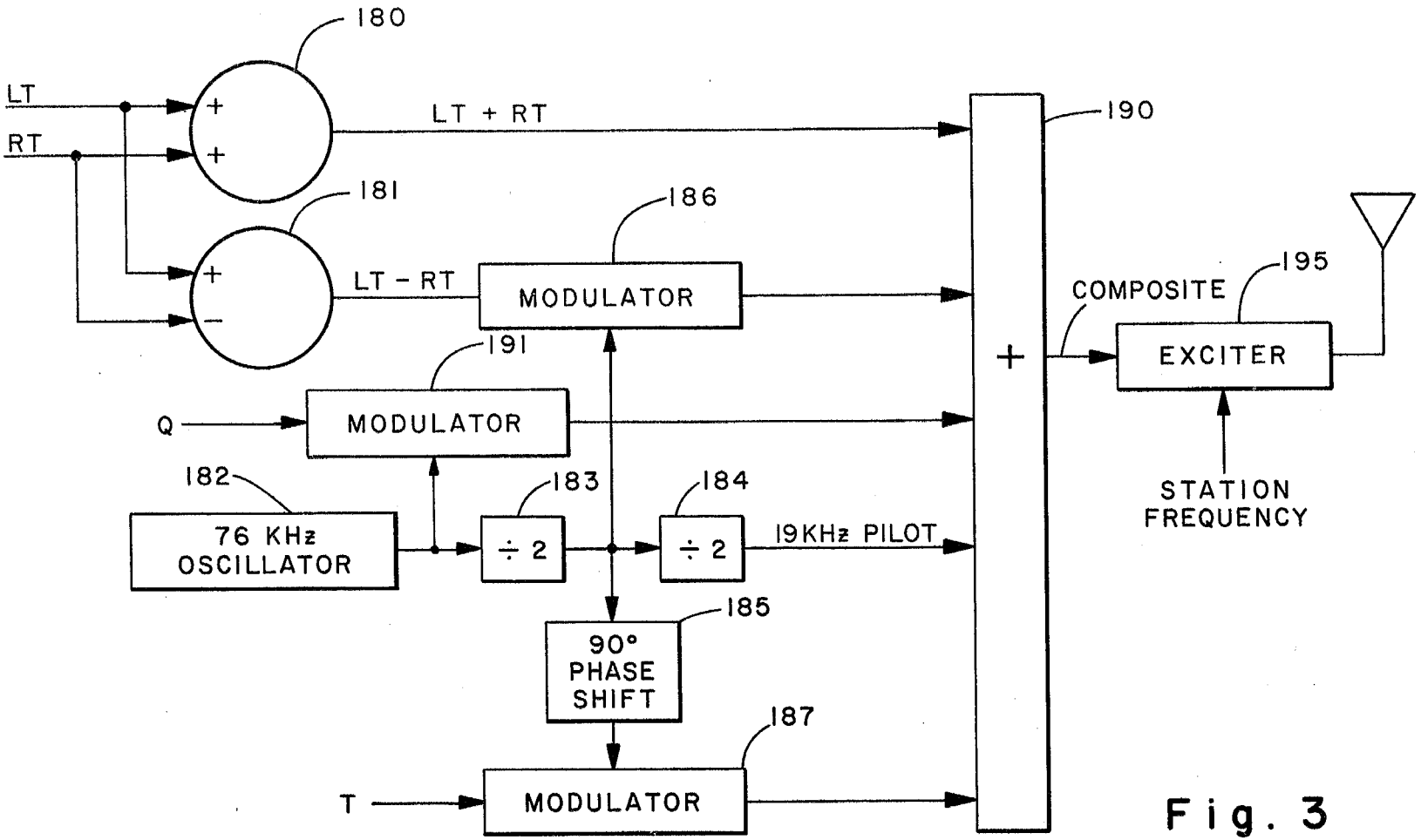
FIG. 3 is a block diagram of a transmitter for four channels of information.

FIG. 3 shows by the way of example a simplified block diagram of a transmitter 30 that can be employed to obtain an FM signal providing the channels as set forth in FIG. 2. Briefly, the sum and difference of LT and RT are formed by the summing circuits 180 and 181 and the sum (LT+RT) is applied to an input terminal of adder 190. An oscillator 182 provides an output at 76 KHz and frequency dividers 183 and 184 are employed in series to make available the characteristic frequencies of 38 KHz and 19 KHz output used as a pilot signal, is coupled to another input terminal of adder 190. The 38 KHz output and a quadrature version thereof formed using 90° phase shifter 185, are coupled to suppressed-carrier type modulators 186 and 187 which modulate the 38 KHz subcarriers with the difference signal (LT−RT) and T, respectively. The outputs of modulators 186 and 187 are coupled to input terminals of adder 190. Similarly, the 76 KHz output is coupled to suppressed-carrier type modulator 191 which modulates the 76 KHz subcarriers with the Q signal.

The outputs of these modulators are coupled to further input terminals of adder 190. The output of adder 190 is a composite signal having a frequency spectrum as shown in FIG. 2 and this composite is coupled to an exciter 195 where it is used to frequency modulate the station frequency.

Other methods for transmitting four channels of information over an FM station varying from the above also have been proposed and may be used in practicing my invention.

The encoder 20 includes a matrix of the type disclosed in applicant's above-referenced U.S. Pat. No. 3,890,466 and shown in modified form in FIG. 4. The matrix has four input terminals 61, 62, 63 and 64 which respectively receive the four independent audio signals LF, LB, RF and RB, which are available as inputs to the encoder 20 (FIG. 1). Phasor representations of these four signals are depicted next to their respective input terminals.

Each of the input terminals 61, 62, 63 and 64 is followed by a pair of phase-shift networks, 69 and 70, 71 and 72, 73 and 74, and 75 and 76, each pair providing a 90° differential phase relationship between their respective outputs. These outputs are appropriately summed at the summing junctions 65 and 66, resulting in the generation of composite signals LT and RT at the output terminals 77 and 78. These are the primary SQ-encoded phasors in the so-called "forward-encoded" mode. It will be seen that the functions LT and RT in this encoder are formed somewhat differently than is shown in FIG. 3 of the aforementioned U.S. Pat. No. 3,937,896.

Figure 4:
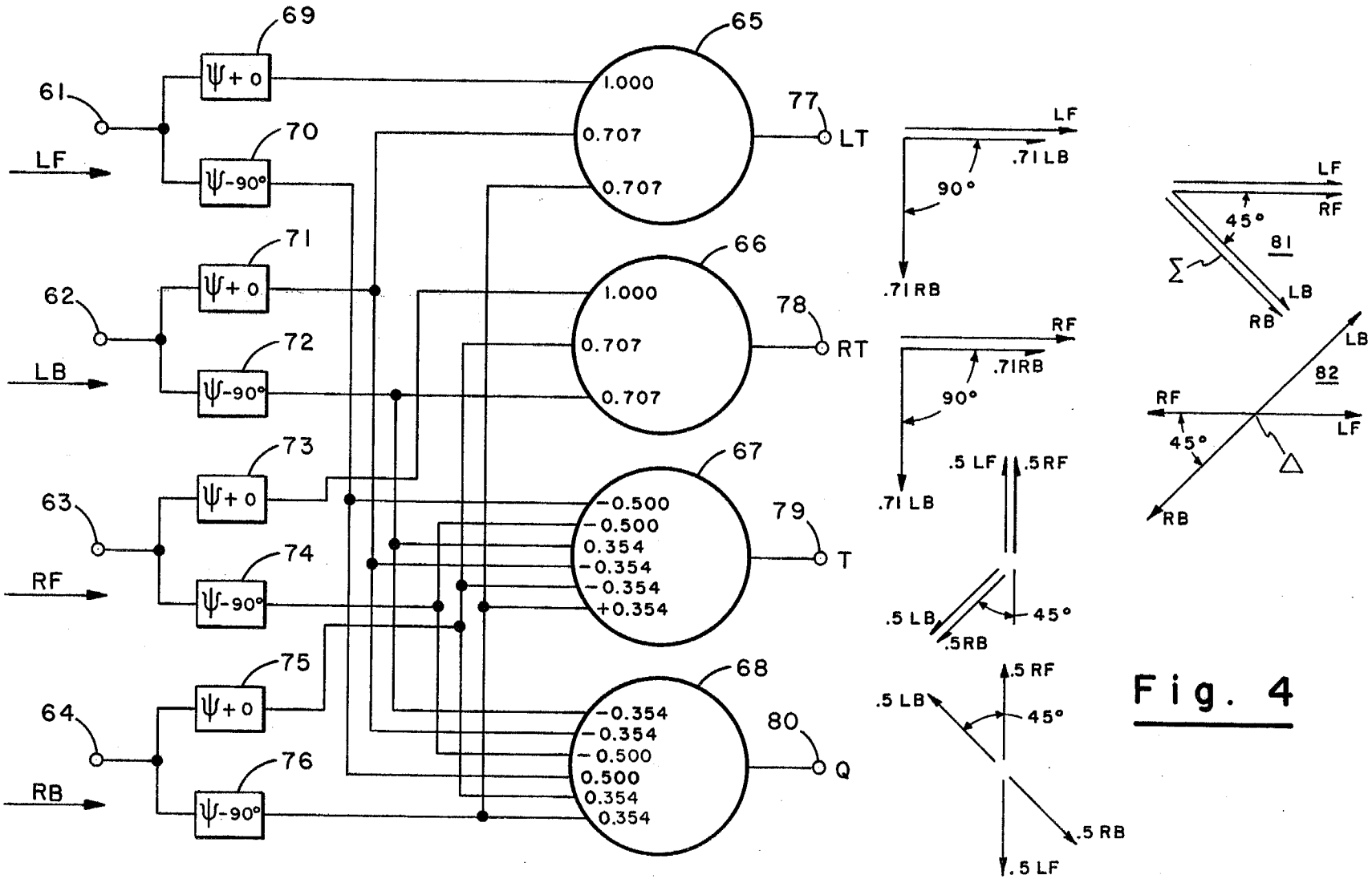
FIG. 4 is a block diagram of an encoding matrix useful in the system of FIG. 1 comprising means for forming the primary LT and RT signals and the auxiliary Q and T signals.

The encoder in FIG. 4 at its terminals 79 and 80 also generates the signals T and Q, respectively. These are formed by summing the appropriate outputs of the phase-shift networks 69, 70, 71, 72, 73, 74, 75 and 76. It will be noted that each of T and Q signals comprise all the cardinal signals LF, LB, RF, and RB in appropriately selected phase relationships the nature of which will be hereinafter explained. The T and Q signals will be combined with the decoded LT and RT signals to convert the decoded matrix signals into "semi-discrete" (4-3-4) signals, and thence into fully discrete (4-4-4) output signals, as will be hereinafter explained.

It should be noticed that the angular position of phasors T and Q in the encoder of FIG. 4 is determined in a particular manner, as will be hereinafter explained, the criteria being that the components of the signal T are in quadrature to the corresponding components of the sum signal (LT+RT), shown as the phasor group 81. This relative orientation of the T-signal is conductive to minimum disruption to the sound of existing FM-stereo receivers in which the detector happens to be improperly aligned. It should be understood, however, that with the provision of a suitable receiver my invention is able to operate with the T-signal and the Q-signal in any phase attitude respecting the (LT+RT) signal 81, a specially propitious modification being shown in FIG. 5.

Figure 5:
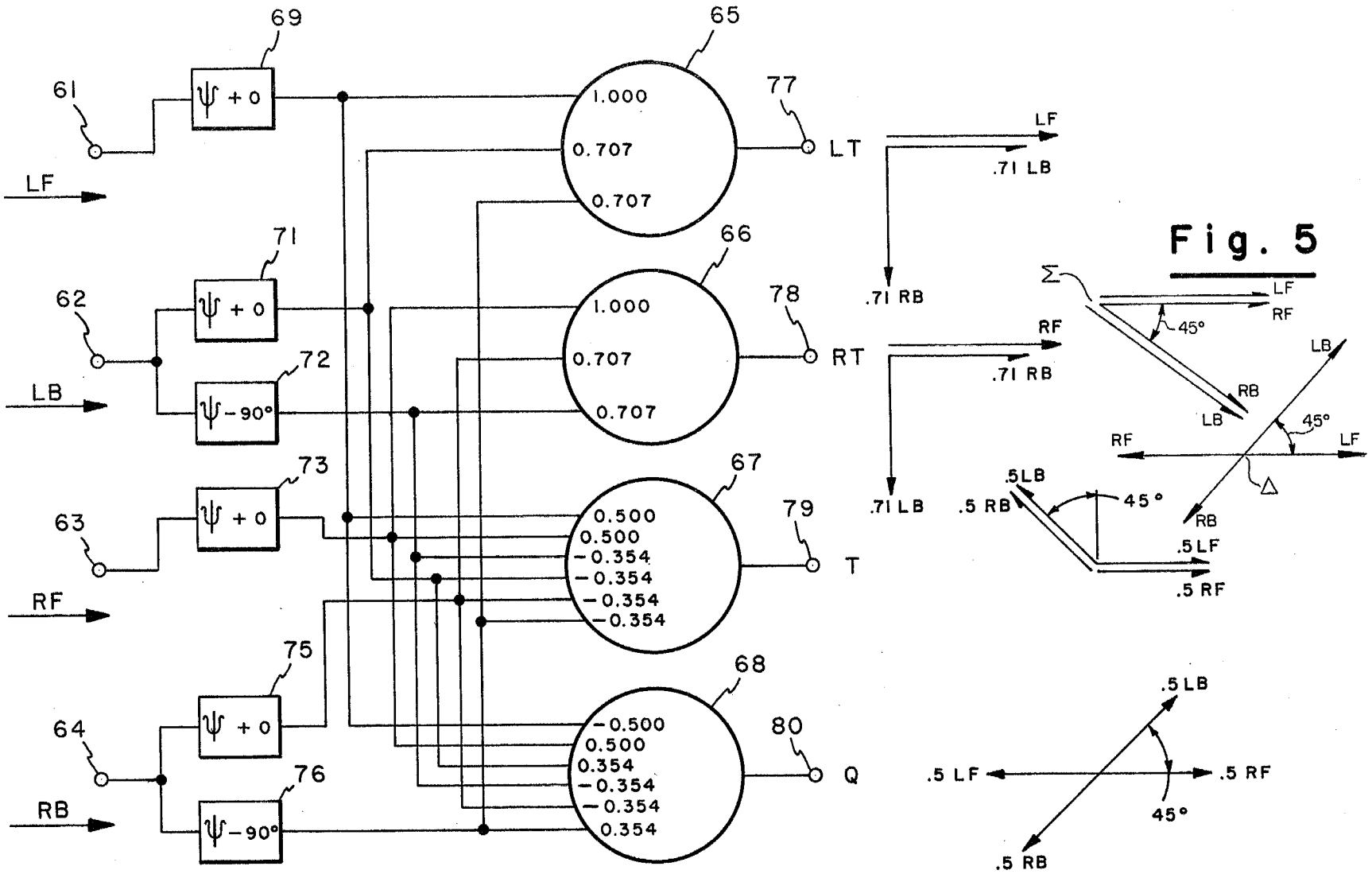
FIG. 5 is a block diagram of a modification of the encoding matrix of FIG. 4 in which the auxiliary signals T′ and Q′ are rotated in phase with respect to the T and Q signals in FIG. 4.

FIG. 5 illustrates an encoder which will respect to the basic SQ LT and RT outputs, at its terminals 77 and 78, respectively, is identical to that shown in FIG. 4. The signals T and Q, at the terminals 79 and 80, however, are formed in such manner that they are rotated with respect to the corresponding T and Q signals in FIG. 4, by an angle of 90°. With this modification, it is noted only six phase shift networks 69, 71, 72, 73, 75, and 76 are required in place of the eight used in the encoder of FIG. 4. By the same token, it will be seen hereinafter that the decoding apparatus of the invention can be provided with a lesser number of phase shift networks than those needed when the encoder of FIG. 4 is used. Therefore, the choice of using the encoder exemplified by FIG. 4, versus that in FIG. 5 depends upon the relative weight placed upon the performance of the older FM receivers versus the concern about the economy in the design of new receivers.

Figure 6:
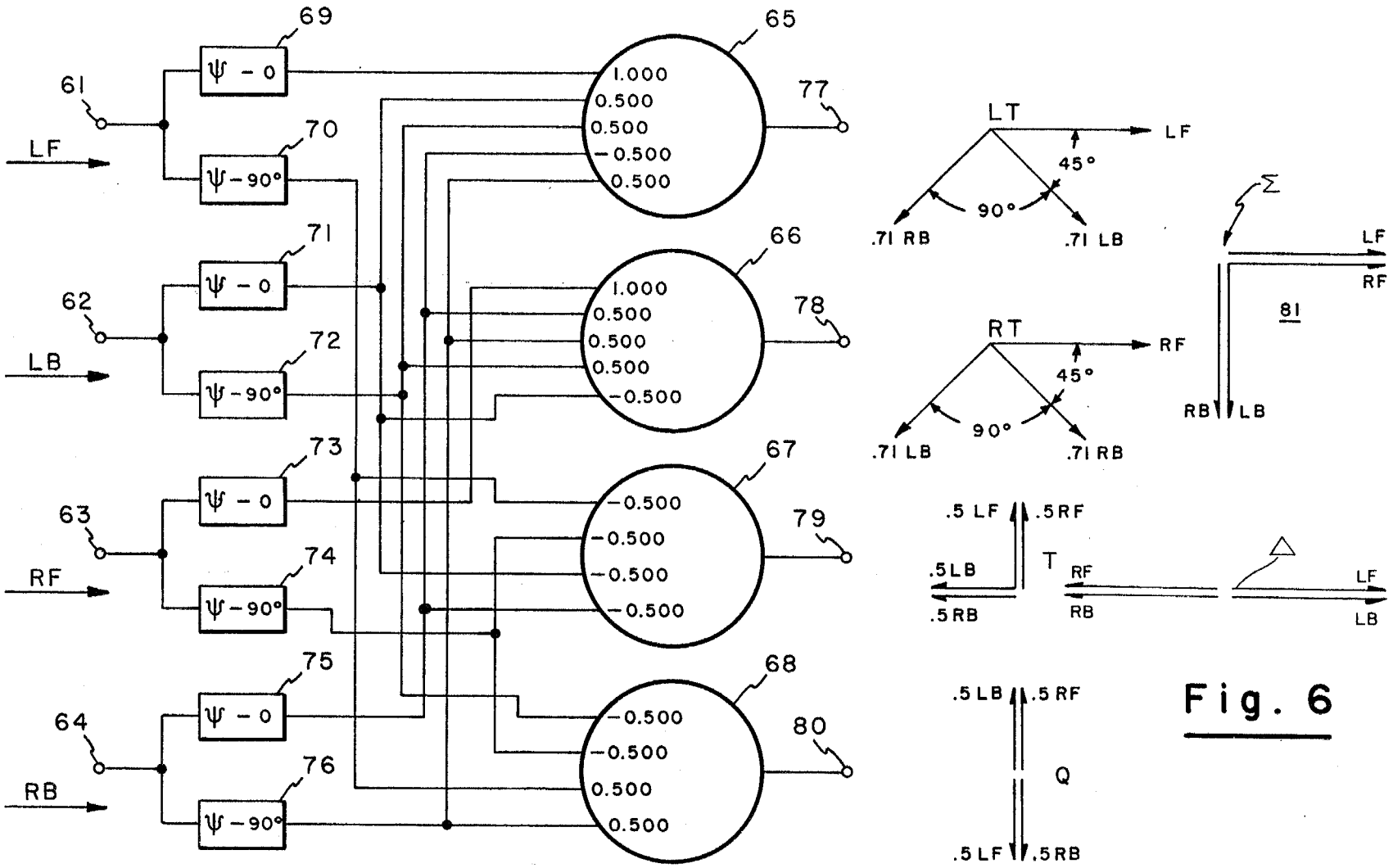
FIG. 6 is a block diagram of another encoding matrix exhibiting modified primary LT and RT signals and correspondingly modified Q and T signals.

Another embodiment of the encoder which may be used in my invention is shown in FIG. 6. This embodiment is similar to that shown in FIG. 4 except that the connections to the adding junctions 65 and 66 have been modified in such manner that the phasors 0.71RB and 0.71LB in both the LT and RT output signals are turned through a phase angle of 45° with respect to the LF and RF phasors, respectively. This organization of phasors comprises still another fully consistent SQ code which offers advantages to be hereinafter described. It is necessary, in this case, also to reorganize the T and the Q signals as shown immediately to the right of the terminals 79 and 80. Considering the sum signal, (LT+RT) (81) and the signal T in FIG. 6, it is noted that the individual phasor components of the signal T are in quadrature with the corresponding signal components of the sum signal 81. As with the encoder in FIG. 4, this relationship results in minimization of the interference of the T-signal with the stereo reception of the broadcast with improperly adjusted existing stereo receivers. Also, as is the case with the encoder in FIG. 4, the encoder in FIG. 6 employs eight phase shift networks 69, 70, 71, 72, 73, 74, 75 and 76.

Figure 7:
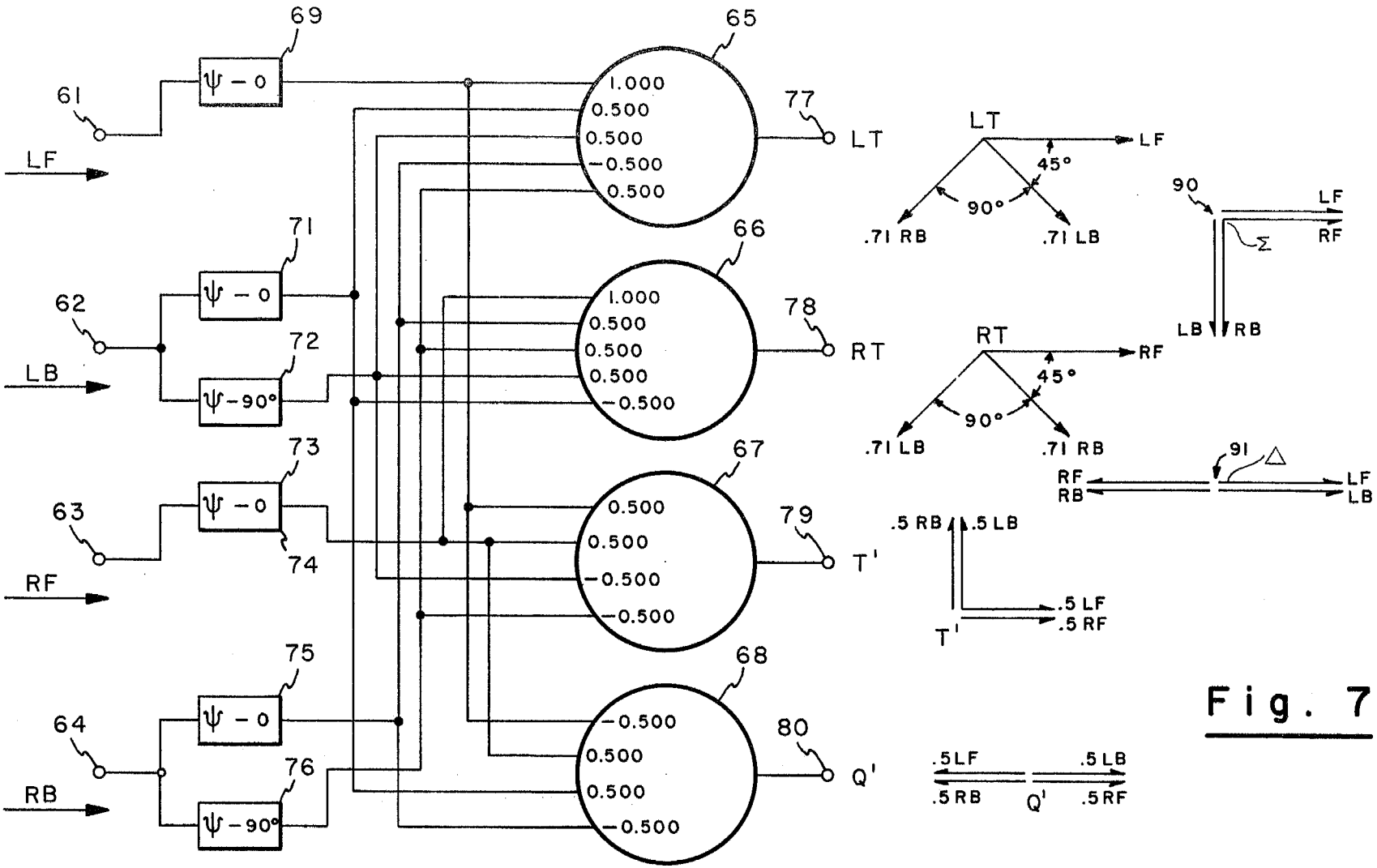
FIG. 7 is a block diagram of a modification of FIG. 6, in which the auxiliary signals T′ and Q′ are rotated in phase with respect to those produced in the FIG. 6 system.

As was shown in connection with the encoder in FIG. 4, it is also possible to reduce the number of phase shift networks in the encoder of FIG. 6 by turning around the T and the Q functions by 90°. This is shown in FIG. 7, where only six phase shift networks are used, namely, 69, 71, 72, 73, 75 and 76. As in previous embodiment, it will be shown that this new position for the signals T and Q (called T′ and Q′, respectively, in FIG. 7) leads to simpler decoding apparatus, utilizing a lesser number of phase shift networks than is needed when decoding signals encoded with the encoder of FIG. 6.

It should be observed that the signals produced by the encoders in FIG. 4 and in FIG. 6 are properly decodable with the same decoder, and that those produced by the encoders of FIG. 5 and FIG. 7 are decodable with a different type of decoder, as will be hereinafter described. This previous observation is related to the 4-3-4 and 4-4-4 type decoding characteristic. The signals produced by any of the above encoders will be properly decoded in the 4-2-4 SQ decoder.

RECEIVER

Figure 8:
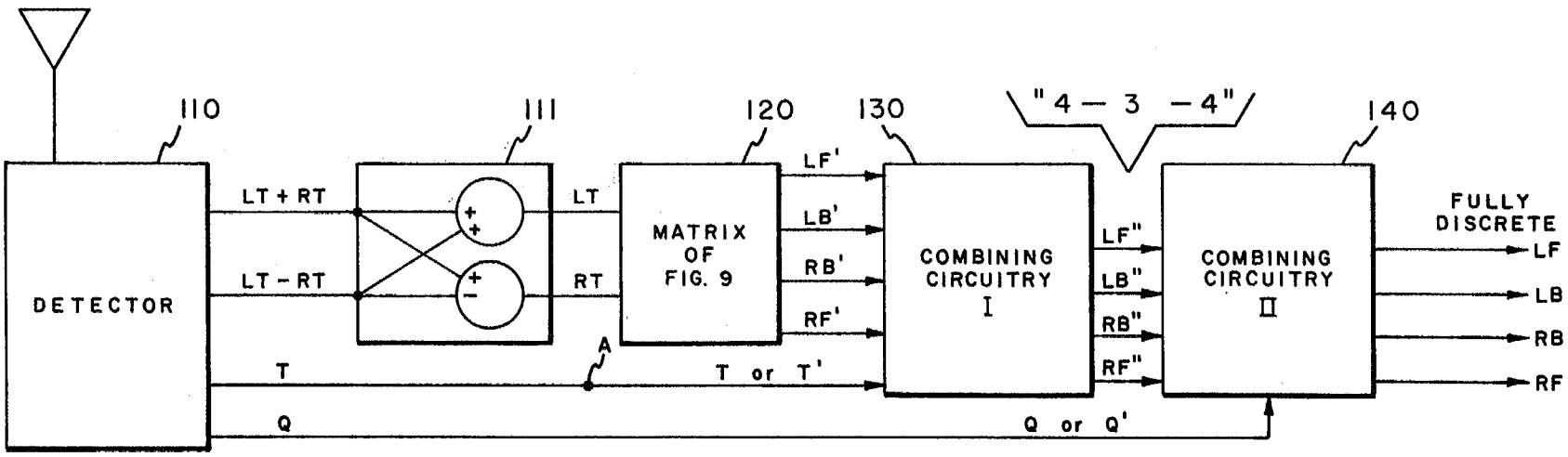
FIG. 8 is a block diagram of a receiving system in accordance with the invention.

FIG. 8 is a generalized block diagram of a receiver in accordance with the present invention. A detector 110 operates to detect and demodulate the signals described in conjunction with FIG. 2; viz., (LT+RT), (LT−RT), T, and Q. The primary information signal (LT+RT), and the secondary information signal, (LT−RT), are combined in a sum/difference matrix 111 which yields the original composite signals LT and RT. These composite signals are coupled to an SQ decoder matrix 120 which may be of various types as set forth in applicant's above-referenced U.S. Pat. No. 3,835,255 one preferred embodiment thereof being described hereinafter in greater detail. It should be noted that this matrix may be equipped with a separation enhancement logic for use with broadcasts in which the T and Q signals are not present. The matrix 120 produces four output signals designated LF′, LB′, RB′ and RF′ which respectively contain, in dominant proportions, the original independent audio signals LF, LB, RB and RF. Each one of the four output signals also contains, in sub-dominant proportion, two "unwanted" components from among the four original signals. The four output signals from matrix 120 are conveyed to combining circuitry 130 which also receives the auxiliary signal T from FM detector 110 resulting in the production of four new signals LF'', LB'', RB'' and RF'' which display a 4-3-4 or semi-discrete character as will be hereinafter shown. Further, a circuit 140 is provided, which receives the aforementioned semi-discrete signals and using the auxiliary signal Q further processes this last set of signals to obtain the four original audio signals LF''', RF''', LB''', and RB''', in discrete form, or equivalent to the original signals LF, RF, LB, and RB.

Figure 9:
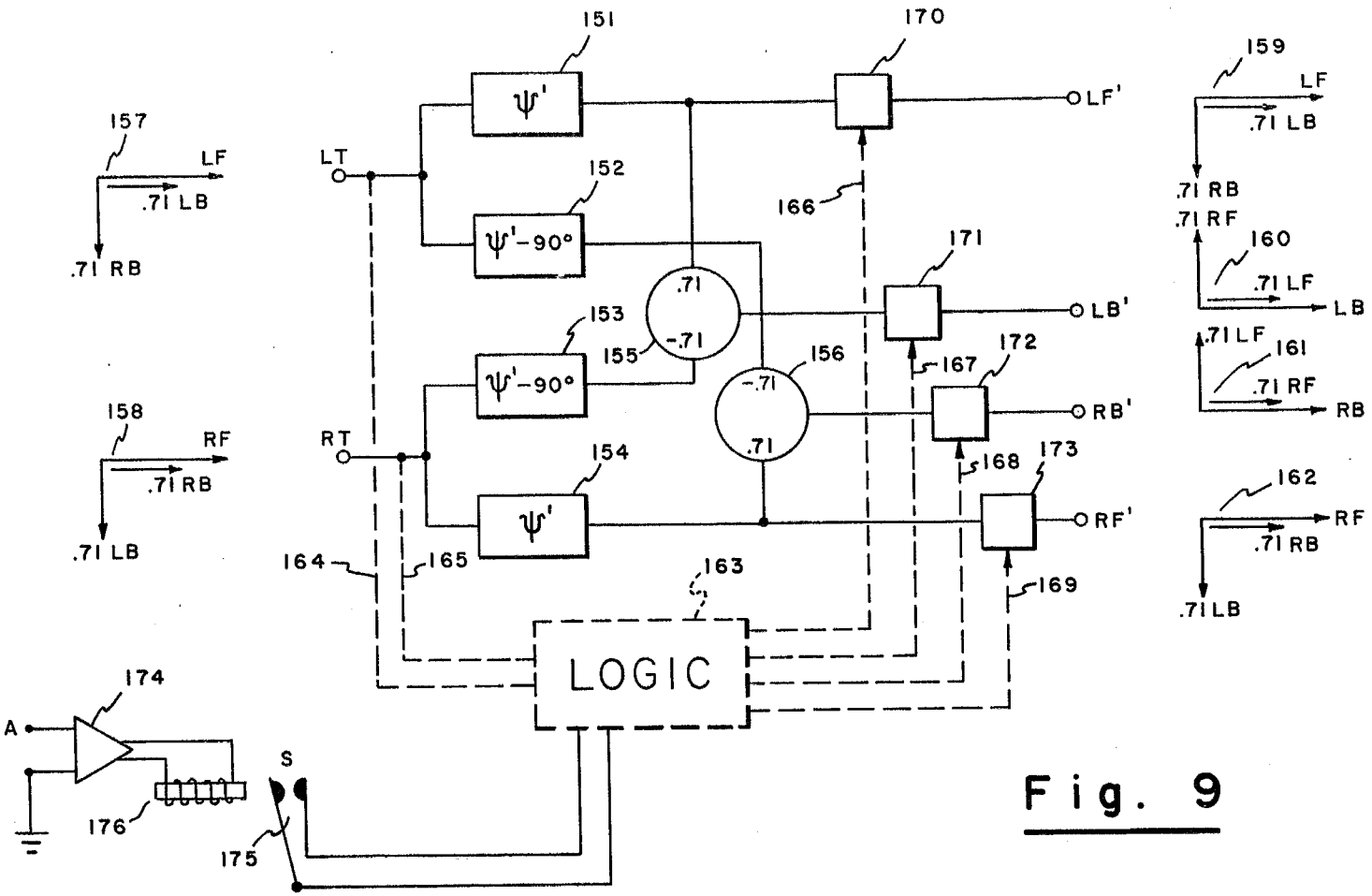
FIG. 9 is a decoder matrix useful as a part of the receiving system of FIG. 8.

A suitable decoder matrix 120 is illustrated in FIG. 9 which shows a matrix that is functionally the same as one disclosed in the above-referenced U.S. Pat. No. 3,937,896. Four all-pass phase shift networks 151, 152, 153 and 154 and a pair of summing circuits 155 and 156 are arranged in the manner shown to decode LT and RT and obtain the four output signals LF', LB', RB' and RT'. It should be noted that the phase-shift networks in the decoder have a basic phase shift $\psi'$, to signify that it may be different from $\psi$ used in the encoder. All the $\psi'$s used in a particular decoder, however, should be alike. The phasor groups 157 and 158 represent LT and RT, respectively, and the phasor groups 159, 160, 161 and 162 represent the decoded outputs LF', LB', RB' and RF', respectively.

The decoder in FIG. 9 can be provided with an optional "logic" function, shown in FIG. 9 in dash line with the objective of enhancing the performance in the 4-2-4 mode, when the T signal (and the Q signal) are not transmitted or received. Several embodiments of such a logic have been described in U.S. Pat. Nos. 3,821,471 and 3,798,373 assigned to the same assignee as this application and, therefore, the logic need not be depicted here in all the details. Suffice it to say that the logic obtains its input from either the LT and RT input terminals or from the corresponding output terminals, and that its action results in the attenuation of the "unwanted" transferred signals into the decoder by means of gain control or subtraction elements 170, 171, 172, and 173. The control voltages from the logic are applied to these elements with the aid of conductors 166, 167, 168, and 169, respectively. The logic can be deactivated with the switch 175, labelled S, which, in turn, is actuated by means of an electromagnet 176 energized by the amplifier 174 controlled by the presence of the signal T at the terminal A, labelled A in FIG. 8. The terminal A is connected through the corresponding terminal A of the amplifier 174 in FIG. 9. When a T voltage is present, current flows through the windings of an electromagnet 176 which pulls the armature of switch S and opens the circuit thereby deactivating the logic. The receiver now operates in the 4-3-4 or the 4-4-4 mode. If a signal T is not present, however, this signifies that the transmission is in a simple 4-2-4 matrix mode; the electromagnet 176 is de-enertized, the switch S is closed, and the logic is turned "on" providing suitable "enhancing" action for the matrixed quadraphonic signals.

4-3-4 AND 4-4-4 RECEIVER PERFORMANCE

Figure 10:
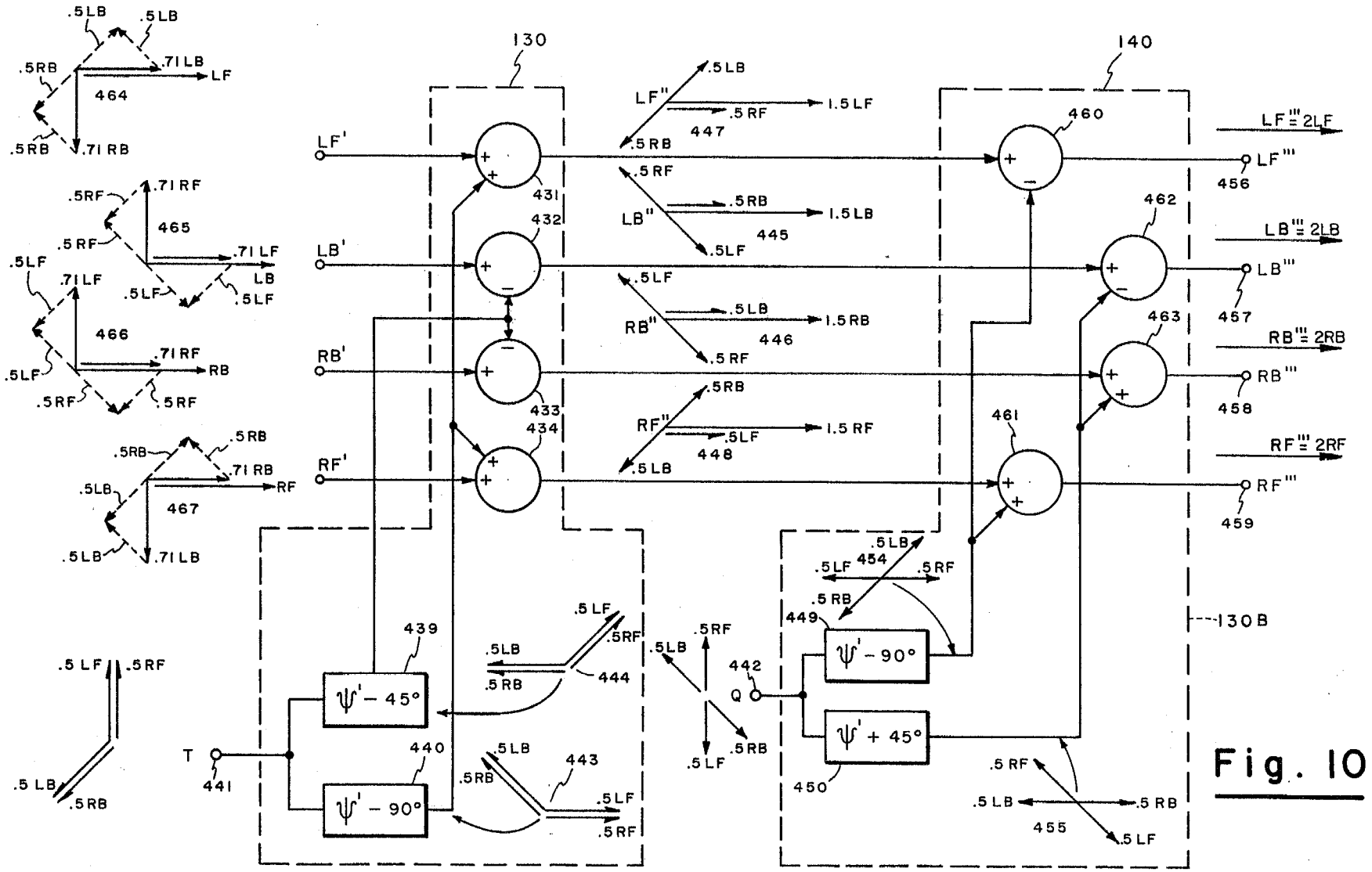
FIG. 10 is a block diagram of a decoder according to the invention adapted to utilize the T and the Q signals provided by the encoders of FIGS. 4 and 6.

The performance of the full receiver is now outlined by reference to FIG. 10, which is intended, primarily, to perform with the type of encoded signals generated by the encoders shown in FIG. 4 or FIG. 6. A full analysis will now be performed for the signals generated by the decoder of FIG. 4, albeit, it will be evident to those skilled in the art that signals produced by the encoder of FIG. 6 can also be used with the decoder of FIG. 10 resulting in an insignificant phase discomformity between the front and the back set of decoded signals. The output signals from the decoder in FIG. 9, namely, LF', LB', RB' and RF', are transferred to the corresponding four input terminals of the combining circuitry 130 in FIG. 10. The signal T from the encoder in FIG. 4 is applied to the terminal 441 of the combining circuitry, this signal, in turn, being relatively phase-shifted by two phase-shift networks 439 and 440, which produce relative phase shifts of $(\psi'-45°)$ and $(\psi-90°)$, respectively. The signals from the phase-shift networks are applied to the two pairs of summing junctions 432 and 433, and 431 and 434, respectively. The output of phase shifter 439 is applied to the junctions 432 and 433 in the subtractive sense, while the output of the phase shifter 440 is applied to the summing junctions 431 and 434 in an additive mode. We now consider the effect of these last four additions.

For example, the signal T applied to terminal 441 is phase shifted by the network 440 by a relative angle of 90° and, therefore, takes on the attitude of the phasor group 443. This phasor group is, in turn, applied to summing junctions 431 and 434. At the summing junction 431 the signal LF' is altered because the phasors 0.5LB and 0.5RB from the phasor group 443 added to their respective phasors 0.71LB and 0.71RB of the phasor group 464, result in foreshortening of these last two phasors which now become 0.5LB and 0.5RB, respectively. By the same token, the phasor 0.5LF of the group 443 added to the phasor LF of the group 464 results in a new phasor which has a length of 1.5LF. Also, the phasor 0.5RF of the phasor group 443 is added to the phasor group 464. These additions result in new phasor group 447 to the right of the summing junction 431 which now constitutes the LF'' output. Following the same approach in summing the phasors 443 and 444 to the remaining phasor groups 465, 466, and 467, results in the three new phasor groups 445, 446, and 448, to the right of the summing junctions 432, 433, and 434. The four output signals of the combining circuitry 130, namely, LF'', LB'', RB'' and RF'', are now characterized by the fact that each has a predominant phasor which is three times as long as the subdominant or unwanted "transfer" signals. The all-around channel separation between these output signals, therefore, is $20\times\log(1.5/0.5)=9.5$dB which is characteristic of the performance of a 4-3-4 system. Proceeding next to the structure and function of the combining circuitry 140 and noticing that the signal Q applied to the terminal 442 is acted upon by two networks 449 and 450 which cause it to become phase shifted through differential phase shift angles of $(\psi'-90°)$ and $(\psi'+45°)$, respectively; this first operation results in the phasor group 454 which when subtracted and added, respectively, at the junctions 460 and 461, results in elimination of the transferred signals in the phasor group 445 and 448, and the generation of an LF''' output at the terminal 456 of the combining circuitry 140, which contains only the LF signal, and the generation of an RF''' output at the terminal 459 of 140 which contains only the RF signal. Likewise, the phasor group 455 subtracted and added, respectively, at the junctions 462 and 463 in combination with the phasor group 445 and 446 produces the two phasors LB''' and RB''' composed of LB and RB signals, respectively. X In this manner by having added successively and appropriately the T and the Q signals to the matrix-decoded phasors 464, 465, 466 and 467, the phasor groups 445, 446, 447, and 448 and the phasors 456, 457, 458, 459, representing respectively a 4-3-4 and a 4-5-4 performance were obtained. It will be evident to those skilled in the art that the circuit in FIG. 10 can be simplified by using but a single set of multiple summing junctions, in place of two sets shown therein.

It will be noted that the total number of phase shift networks required in the carrying out of the invention described in FIGS. 9 and 10 is as follows: four in the matrix circuit in FIG. 9; two additional ones, 439 and 440 to convert the output of FIG. 9 to a 4-3-4 configuration, and two more 449 and 450 to produce the 4-4-4 configuration; or a total of six or eight phase shift networks to achieve the semi-discrete or the discrete type of performance, respectively. It will now be shown that the use of an alternative method of formation of signals T and Q can simplify the decoding circuitry and allows it to perform with a lesser number of phase-shift networks. This modification will be explained in connection with the signals produced by the encoder of FIG. 7.

DESCRIPTION OF ALTERNATE RECEIVER

Figure 11:
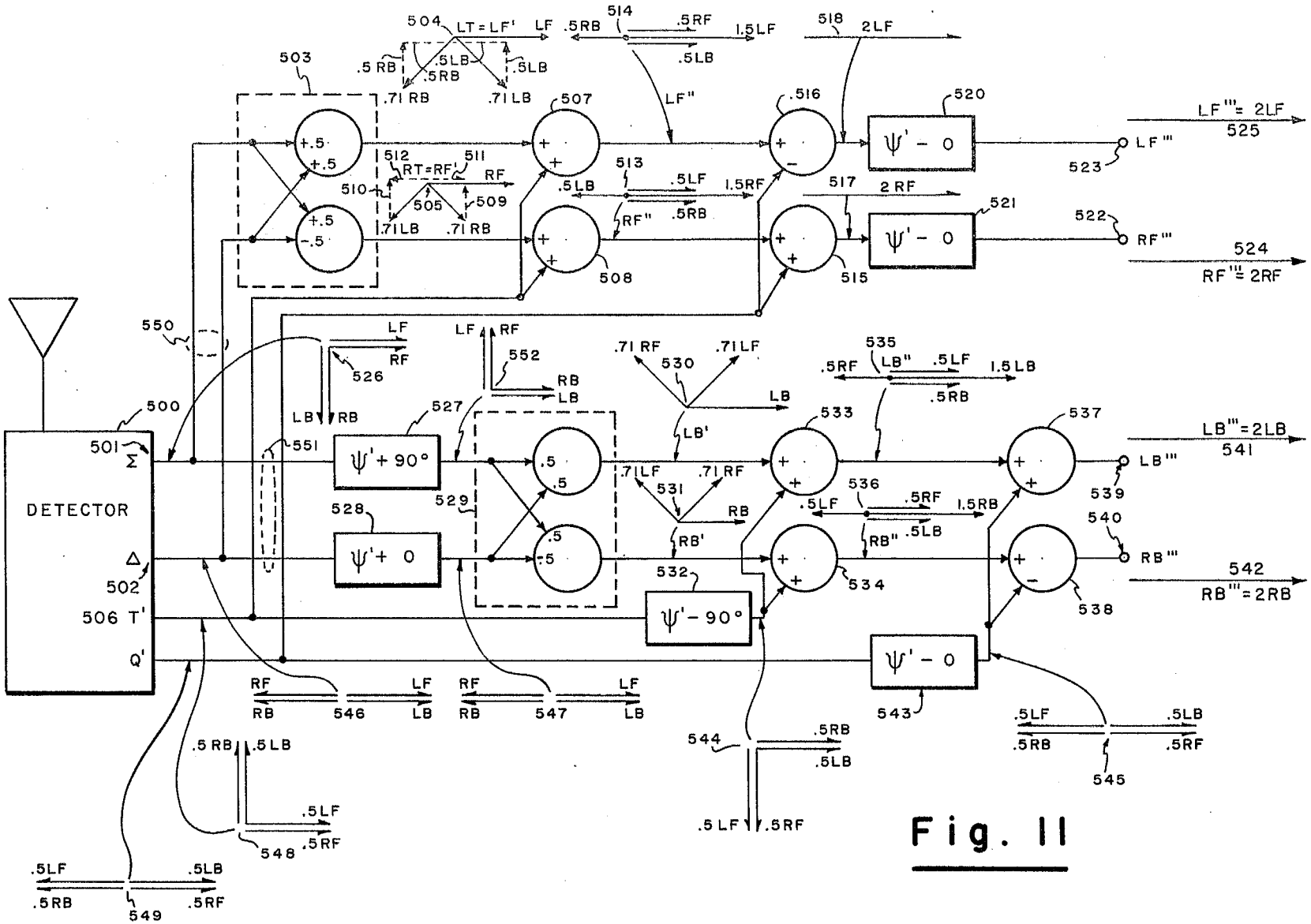
FIG. 11 is a block diagram of a simplified decoder according to the invention utilizing signals provided by the encoders of FIGS. 5 and 7.

It will be remembered by reference to FIG. 2 that the transmitter is modulated with the sum signal (LT+RT) which becomes the "primary information signal", and with the difference signal which modulates a suppressed subcarrier at 38 KHz, called a "secondary information signal". Referring to FIG. 11, it will again be remembered that the detector recovers this primary information signal Σ, and the secondary information signal Δ. In the decoder of FIG. 11, Σ and Δ go through two separate paths: one path, circumscribed by the dash-line ellipse 550 leads to a sum and difference matrix 503. Examining the phasor group Σ, numbered 526, and phasor group Δ, number 546, it becomes evident that after the application of the coefficents 0.5 in the matrix 503, the sum of these two signals becomes LT, depicted by the phasor 504, and, by subtracting the phasor group 546 from the phasor group 526, after the application of the coefficients 0.5 produces the phasor group RT, numbered 505. It will be recognized that, except for an additional stage of phase shift ψ′ hereinafter described, LT and RT are also equivalent to the decoded front signals LF′ and RF′ of a 4-2-4 matrix system, and they may be used as such in a conventional SQ decoding mode.

At this point we can convert the aforementioned LF′ and RF′ into the 4-3-4 form of signals by addition of the T′ signal at the terminal 506 of the receiver, which is represented by a phasor group number 548. It will be noted that since in the encoder of FIG. 7 the phasor group T′ has been suitably oriented with respect to LT and RT, it may be added thereto without intermediate phase shifting. This is done at the adding junctions 507 and 508, respectively. It will be noted, for example, that the phasors .5RB and .5LB in the phasor group 548, when added to the phasor groups 504 and 505 results in the foreshortening of the phasors. .71RB and .71LB in these latter two phasor groups by a factor $1/\sqrt{2}$; while the addition of the phasors .5LF and .5RF in the phasor group 548 to the phasor groups 504 and 505 causes the phasors LF and RF in these two latter phasor groups to be lengthened by the quantity 0.5. The results of the aforementioned adding operations are shown by the phasor groups 513 and 514 in FIG. 11, which represent the 4-3-4 decoded signals LF″ and RF″.

The next step is to convert the 4-3-4 decoded signals into 4-4-4 "discrete" signals. This is accomplished by adding the Q′ signal, portrayed by the phasor group 549, to the phasor groups 513 and 514, with the aid of adding junctions 515 and 516, respectively. Because the phasor group 549 has already been properly aligned to begin with, in the endocer of FIG. 7, this addition is accomplished without necessity of employing any intermediate phase shift networks. As a result of the addition, it is seen that the transferred signals .5LF, .5RF, .5LB and .5RB, in the phasors 513 and 514 are cancelled by the corresponding phasors in the Q′ signal 549, resulting in the respective discrete signals 517 and 518 which are equal to 2RF and 2LF, respectively. Therefore, except for a scaling factor of two, the decoder in FIG. 11 has recovered the discrete signals LF and RF without the necessity of using any added phase shift networks.

Returning now to the second branch of the sum signal 501 and the difference signal 502, these are conveyed by two conductors encircled by dash line ellipse 551 to two phase shift networks 527 and 528 which shift their respective phases by (ψ′+90°) and (ψ′+0°) causing the phasor groups 526 and 546 to take on the attitude depicted by th phasor groups 547 and 552. These latter two signals are conveyed to a sum and difference matrix 529 which includes 0.5 coefficients. By performing the sum and difference operations indicated in the matrix 529 decoded signals LB′ and RB′ are obtained. These are depicted by phasor groups 530 and 531.

Thus, it is seen, that the decoder in FIG. 11 provides the 4-2-4 decoded phasors, LF′, RF′, LB′ and RB′, Nos. 504, 505, 530 and 531, respectively, with the use of but two phase shift networks 527 and 528, featuring the fact that the first pair of phasors, LF′ and RF′ are properly aligned with respect to each other, as is the second pair of phasors LB′ and RB′. Previous attempts to produce the 4-2-4 decoding of SQ signals with but two shift networks did not produce this desired result. On the other hand, it should also be noted that the first pair of phasors LF′ and RF′ are not in phase with the second pair of phasors LB′ and RB′. This factor is of no consequence in the normal course of events, but it could become of significance if there were common signals between these two pairs. A means for improving this not-in-phase condition is described hereinafter.

To convert the output signals LB′ and RB′ to the 4-3-4 configuration, the signal T′ must be added, but in order to perform this addition correctly, it must be passed through a phase shift network 532, which provides a phase shift (ψ′−90°) which, in the first place, provides the ψ′ function to compensate for the ψ′ function introduced by phase shift networks 527 and 528, and which further shifts T′ by 90° in order to align it properly with the signals LB′ and RB′. The emerging signal 544 at the output of the phase shift 532 is now added to the signals LB′ and RB′ in summing junctions 533 and 534. As with the previous example, this operation results in foreshortening of the phasors .71LF and .71RF by a factor $1/\sqrt{2}$ , and lengthening of the phasors LB and RB by 0.5 producing two 4-3-4-type signals 535 and 536, designated as LB″ and RB″, respectively. In these signals, the desired original directional signal, LB or RB, has a relative length 1.5, while the undesired or "transferred" signals have respective lengths of 0.5. Therefore, the decoder in FIG. 11 produces the desired four 4-3-4 type signals 513, 514, 535 and 536, having an all-around separation 20 log (1.5/0.5)=9.5db. Furthermore, it is seen that when "split signals" composed of signals applied equally to adjacent channels are present, there will exist a total separation between. center-front and center-back and center-left and center-right channels, and vice versa. For example, if a Center-Left (CF) signal, consisting of equal LF and LB signals, is applied to the encoder, these signals are cancelled completely in the RF and the RB channels, appearing only in the LF and the LB channels of the decoded quad of signals 513, 514, 535 and 536. This is an advantage of the phasor configuration produced by the encoder in FIGS. 6 and 7, over that produced by the encoders in FIGS. 4 and 5. It will now be noticed that the quad of 4-3-4 signals, 513, 514, 535 and 536, have been produced with but three phase shift networks 527, 528 and 532, as against the six networks required for the performance of this same function with the decoder in FIG. 10.

As a next step, the 4-3-4 signals 535 and 536 may be converted to fully discrete 4-4-4 signals through the addition of the function Q'. This addition necessitates an additional phase shift network 543, which provides a phase shift angle of ($\psi'-0$) to the signal 549, thereby eliminating the effect of $\psi'$ introduced by networks 527, 528 and 532. The addition is performed in two adding junctions 537 and 538 which produce at their respective output terminals 539 and 540 the signals 541 and 542, which are discrete signals LB" and RB", respectively. Thus, the decoder of FIG. 11 produces a set of four discrete signals 517, 518, 541 and 542. This reconstruction is accomplished with the use of but four phase shift networks 527, 528,, 532 and 543, as compared to the eight networks required in the decoder of FIG. 10.

It will be observed, however, that all thus far described signals in the branch derived from signals 550 are positioned at an angle $\psi'$ with respect to the signals in the branch derived from signals 551. This seeming anomaly is not too serious and is not likely to be noticed if the $\psi'$ function is properly chosen; thus the above-described arrangement is appropriate in those decoders where economy is paramount. In higher performing decoders it is preferable to remove the anomaly, and this can be done by adding two phase shift networks 520 and 521 at the output of summing junctions 515 and 516. This provides the displacement $\psi'$ to all the signals derived from branch 550 signals and places them in proper relationship with those derived from branch 551 signals. The advantage over the decoder in FIG. 10 is still retained, however, in that the two additional phase-shifters bring the total number used in the decoder of FIG. 11 to six, number used in the decoder of FIG. 11 to six, as compared with the eight required in the decoder of FIG. 10. While the invention has been described with reference to specific embodiments, it will be appreciated that variations within the spirit and scope of the invention will occur to those skilled in the art. For example, it will be understood that, if desired, the auxiliary signals T and Q can be transmitted at less than full band width without severe degradation of the decoded signals. It is to be understood, also, that the term "transmitting or processing" as used in the claims may include the step of recording the LT, RT, T and Q signals on a suitable medium, such as magnetic tape of disc record. That is, the principal composite signals LT and RT may be respectively recorded on the left and right baseband channels of a stereophonic disc record, and one or both of the T and Q composite-signals recorded on carriers allocated to one or both of the stereo channels, for subsequent replay, demodulation and decoding. It is also intended that the described signal proportions, phase relationships, etc. may vary within a range of manufacturing tolerances according to the understanding of those skilled in the art without departing from the spirit of the invention.

I claim:

1. Apparatus for transmitting or processing four directional audio signals designated LF, RF, LB and RB over a medium having primary and secondary information channels and a first auxiliary channel, said primary and secondary channels carrying information that is consistent and compatible with existing monophonic and stereophonic standards, including an encoder comprising:

means for forming a first composite signal designated LT which contains, to the extent they are present, LF in a dominant proportion and LB and RB in sub-dominant proportions, LB and RB being phase-shifted with respect to each other;

means for forming a second composite signal designated RT which contains, to the extent they are present, RF in a dominant proportion and LB and RB in sub-dominant proportions, LB and RB being phase-shifted with respect to each other and respectively lagging and leading LB and RB in said first composite signal by substantially 90°;

means for forming at least a first auxiliary composite signal containing, to the extent they are present, equal proportions of LF, RF, LB and RB of lesser value than the sub-dominant proportions of LB and RB in the first and second composite signals, which in the first auxiliary composite signal have phase angles either all substantially perpendicular or all substantially parallel to those of corresponding signals in a composite signal representing the sum of LT and RT;

means for forming a sum signal as a function of the sum of LT and RT and for applying said sum signal to the primary information channel;

means for forming a difference signal as a function of the difference between LT and RT and for applying said difference signal to the secondary information channel; and means for applying the first auxiliary signal to said first auxiliary channel.

2. In a compatible four channel audio system for use in conjunction with a radio transmission system for transmitting four individual audio signals designated LF, LB, RB and RF over a medium having primary and secondary information channels and first and second auxiliary information channels, said primary and secondary channels carrying information that is consistent and compatible with existing monophonic and stereophonic standards, wherein the transmitter portion of said system comprises means for forming a first composite signal designated LT which, contains, to the extent they are present, LF in a dominant proportion and LB and RB in sub-dominant proportions, LB and RB being phase-shifted with respect to each other; means for forming a second composite signal designated RT which contains, to the extent they are present, RF in a dominant proportion and LB and RB in sub-dominant proportions, LB and RB being phase-shifted with respect to each other and respectively lagging and leading LB and RB in said first composite signal by 90°; means for forming at least the first of first and second auxiliary composite signals designated T and Q, respectively, each of which contains, to the extent they are present, equal proportions of LF, RF, LB and RB of lesser value than the sub-dominant proportions of LB and RB in said first and second composite signals and which in said signal T have phase angles either all substantially perpendicular or all substantially parallel to those of corresponding signals in a composite signal representing the sum of LT and RT, and which in said signal Q have phase angles either all substantially parallel or all substantially perpendicular to those of corresponding signals in a composite signal representing the difference between LT and RT; means for forming a sum signal as a function of the sum of LT and RT and for applying said sum signal to the primary information channel; means for forming a difference signal as a function of the difference between LT and RT and for applying said difference signal to said secondary information channel; and means for applying said first and said second auxiliary signals to said first and second auxiliary channels, respectively, a receiver/decoder comprising:

means responsive to said primary and secondary channels for processing said sum and difference signals to obtain said LT and RT signals;

matrix means for combining said LT and RT signals in predetermined amplitude and phase relationships to obtain four intermediate signals, each of which has a different one of said individual audio signals predominant and contains in sub-dominant proportion transferred portions of others of said individual audio signals; and means for combining relatively phase-shifted versions of said T signal with said four intermediate signals in phase relationships to recover four output signals, each of which has a different one of said individual audio signals predominant and wherein the proportions of said transferred portions are diminished relative to their associated predominant signal as compared to the relative proportions of the predominant and transferred portions in said intermediate signals.

3. Apparatus according to claim 2, wherein said receiver/decoder further comprises:

means for combining relatively phase-shifted versions of said Q signal with said output signals in phase relationships to cancel said transferred portions from said output signals thereby to recover said four directional audio signals.

4. A receiver/decorder according to claim 2, wherein said means for combining said T signal with said intermediate signals comprises:

means for producing two relatively phase-shifted versions of said T signal, means for adding one phase-shifted version of said T signal to two of said intermediate signals, and means for adding or subtracting the other phase-shifted version of said T signal to or from the other two of said intermediate signals.

5. A receiver/decoder according to claim 3, wherein said means for combining relatively phase-shifted versions of said Q signal with said output signals comprises:

means for forming two relatively phase-shifted versions of said Q signal, means for adding or subtracting one of said phase-shifted versions of said Q signal to or from two of said output signals, and means for adding or subtracting the other phase-shifted version of said Q signal to or from the other two of said output signals.

6. Apparatus for receiving, from first and second channels, first and second composite signals representing the sum and difference, respectively, of signals designated LT and RT, and a first auxiliary composite signal, the said signals being derived from four directional audio signals designated LF, RF, LB and RB, and the LT signal containing, to the extent they are present, LF in a dominant proportion and LB and RB in sub-dominant proportions, LB and RB being phase-shifted with respect to each other, the RT signal containing, to the extent they are present, RF in a dominant proportion and LB and RB in sub-dominant proportions, LB and RB being phase-shifted with respect to each other and respectively lagging and leading LB and RB in the LT signal by substantially 90° , and the first auxiliary composite signal containing, to the extent they are present, equal proportions of LF, RF, LB and RB of lesser value than the sub-dominant proportions of LB and RB in the first and second composite signals, which have phase angles either all substantially perpendicular or all substantially parallel to those of corresponding signals in a composite signal representing the sum of LT and RT, the apparatus including a decoder comprising:

means responsive to the primary and secondary channels for processing the sum and difference signals to obtain the LT and RT signals;

matrix means for combining the LT and RT signals in predetermined amplitude and phase relationship to obtain four intermediate signals, each of which has a different one of the individual audio signals predominant and contains in sub-dominant proportion transferred portions of others of the individual audio signals; and means for combining relatively phase-shifted versions of the first auxiliary composite signal with the intermediate signals in phase relationship to recover four output signals, each of which has a different one of the individual audio signals predominant and wherein the proportions of the transferred portions are diminished relative to their associated predominant signal as compared to the relative proportions of the predominant and transferred portions in the intermediate signals.

7. A system for transmitting or processing four directional audio signals and receiving the transmitted or processed signals including an encoding apparatus according to claim 1 and a decoding apparatus according to claim 6.

8. System according to claim 7, wherein the encoder of said transmitting or processing apparatus further includes means for forming a second auxiliary composite signal containing, to the extent they are present, equal proportions of LF, RF, LB and RB of lesser value than the sub-dominant proportions of LB and RB in the first and second composite signals, which have phase angles either all substantially parallel or all substantially perpendicular to those of corresponding signals in a composite signal representing the difference between LT and RT.

9. System according to claim 8, wherein the decoder of said receiving apparatus further comprises:

means for combining relatively phase-shifted versions of the second auxiliary composite signal with the output signals in phase relationships to cancel the transferred portions and thereby recover the four directional audio signals.

10. System according to claim 7 or 8, wherein the means for combining the first auxiliary composite signal with the intermediate signals comprises:

means for producing two relatively phase-shifted versions of the first auxiliary composite signal, means for adding one phase-shifted version of the first auxiliary composite signal to two of the intermediate signals, and means for adding or substracting the other phase-shifted version of the first auxiliary composite signal to or from the other two of the intermediate signals.

11. System in accordance with claim 9, wherein the means for combining relatively phase-shifted versions of the second auxiliary composite signal with the output signal comprises:

means for forming two relatively phase-shifted versions of the second auxiliary composite signal, means for adding or subtracting one of the phase-shifted versions of the second auxiliary composite signal to or from two of the output signals to produce one pair of fully discrete directional signals, and means for adding or subtracting the other phase-shifted version of the second auxiliary composite signal to or from the other two of the output signals to produce another pair of fully discrete directional signals.

12. A system in accordance with claim 11, wherein said system further includes means for imparting a phase-shift to one pair of fully discrete directional signals in order to bring it into phase with the other pair of fully discrete directional signals.

13. Apparatus according to claim 1, wherein said apparatus further includes means for forming a second auxiliary composite signal containing, to the extent they are present, equal proportions of LF, RF, LB and RB of lesser value than the subdominant proportions of LB and RB in the first and second composite signals, which have phase angles either all substantially parallel or all substantially perpendicular to those of corresponding signals in a composite signal representing the difference between LT and RT.

14. Apparatus according to claim 6, for receiving the said first and second composite signals, the said first auxiliary composite signal, and a second auxiliary composite signal containing, to the extent they are present, equal proportions of LF, RF, LB and RB of lesser values than the sub-dominant proportions of LB and RB in the first and second composite signals, which have phase angles either all substantially parallel or all substantially perpendicular to those of corresponding signals in a composite signal representing the difference between LT and RT, wherein said decoder further comprises:

means for combining relatively phase-shifted versions of the said second auxiliary composite signal with the output signals in phase relationships to cancel the transferred portions and thereby recover the four directional audio signals.

15. Apparatus according to claim 6, or claim 14, wherein the means for combining the first auxiliary composite signal with the intermediate signals comprises:

means for producing two relatively phase-shifted versions of the first auxiliary composite signal, means for adding one phase-shifted version of the first auxiliary composite signal to two of the intermediate signals, and means for adding or subtracting the other phase-shifted version of the first auxiliary composite signal to or from the other two of the intermediate signals.

16. Apparatus according to claim 15, wherein the means for combining relatively phase-shifted versions of the second auxiliary composite signal with the output signal comprises:

means for forming two relatively phase-shifted versions of the second auxiliary composite signal to or from two of the output signals to produce one pair of fully discrete directional signals, and means for adding or subtracting the other phase-shifted version of the second auxiliary composite signal to or from the other two of the output signals to produce another pair of fully discrete directional signals.

17. Apparatus in accordance with claim 16, wherein said apparatus further includes means for imparting a phase-shift to one pair of fully discrete directional signals in order to bring it into phase with the other pair of fully discrete directional signals.

* * * * *